US009415296B1

(12) United States Patent
Miller

(10) Patent No.: US 9,415,296 B1
(45) Date of Patent: Aug. 16, 2016

(54) SKATEBOARD ACCESSORY

(71) Applicant: Cornell Miller, New York, NY (US)

(72) Inventor: Cornell Miller, New York, NY (US)

( * ) Notice: Subject to any disclaimer, the term of this patent is extended or adjusted under 35 U.S.C. 154(b) by 0 days.

(21) Appl. No.: 14/930,527

(22) Filed: Nov. 2, 2015

Related U.S. Application Data

(60) Provisional application No. 62/073,628, filed on Oct. 31, 2014.

(51) Int. Cl.
*A63C 17/01* (2006.01)
*A63C 17/26* (2006.01)

(52) U.S. Cl.
CPC ..... *A63C 17/26* (2013.01); *A63C 17/017* (2013.01)

(58) Field of Classification Search
CPC ..... A63C 1/26; A63C 17/00; A63C 17/01; A63C 17/0006; A63C 17/002; A63C 2017/0053; A63C 2203/00; A63C 2203/08; A63C 2203/42; A63C 2203/46; A63C 2203/52; A63C 17/017
See application file for complete search history.

(56) References Cited

U.S. PATENT DOCUMENTS

| | | | | | |
|---|---|---|---|---|---|
| 4,930,794 | A * | 6/1990 | Chan | A63C 17/01 | 280/11.28 |
| 5,052,702 | A * | 10/1991 | Chan | A63C 17/01 | 280/11.28 |
| 7,237,784 | B1 * | 7/2007 | Monteleone | A63C 17/01 | 280/87.03 |
| 7,506,880 | B2 * | 3/2009 | Burwell | A63C 17/01 | 280/87.01 |
| 7,752,775 | B2 * | 7/2010 | Lyden | A43B 1/0081 | 36/100 |
| 7,837,204 | B1 * | 11/2010 | Groenenboom | A63C 17/0093 | 280/11.27 |
| 2013/0175773 | A1 * | 7/2013 | Sherley | A63C 17/01 | 280/11.19 |
| 2014/0138937 | A1 * | 5/2014 | Woncik | A63C 17/0006 | 280/639 |
| 2015/0001817 | A1 * | 1/2015 | Imbrie | A63C 17/015 | 280/11.27 |
| 2015/0238845 | A1 * | 8/2015 | Clayton | B62K 3/002 | 280/87.042 |

* cited by examiner

*Primary Examiner* — John Walters
*Assistant Examiner* — Brian Swenson
(74) *Attorney, Agent, or Firm* — Kelley Drye & Warren LLP

(57) ABSTRACT

A skateboard is configured to receive at least one faceplate. The skateboard has a motherboard which further has a top side, a bottom side, a front end, and a rear end. The motherboard is symmetrical about a central axis which runs from the front end to the rear end. A forward truck and a rearward truck are attached to the motherboard. A plurality of slots are arranged symmetrically about the central axis on the motherboard. The plurality of slots are adapted to receive the at least one faceplate.

10 Claims, 6 Drawing Sheets

SKATEBOARD ACCESSORY

RELATED APPLICATION

This application claims priority to provisional patent application U.S. Ser. No. 62/073,628 filed on Oct. 31, 2014, the entire contents of which is herein incorporated by reference.

BACKGROUND

The embodiments herein relate generally to skateboards and skateboard accessories.

Prior to embodiments of the disclosed invention, switching a deck on a skateboard was a time consuming process. A deck could need to be replaced as a result of damage, a change in design taste or any other reason. Embodiments of the disclosed invention solve this problem.

SUMMARY

A skateboard is configured to receive at least one faceplate. The skateboard has a motherboard which further has a top side, a bottom side, a front end, and a rear end. The motherboard is symmetrical about a central axis which runs from the front end to the rear end. A forward truck and a rearward truck are attached to the motherboard. A plurality of slots are arranged symmetrically about the central axis on the motherboard. The plurality of slots are adapted to receive the at least one faceplate.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
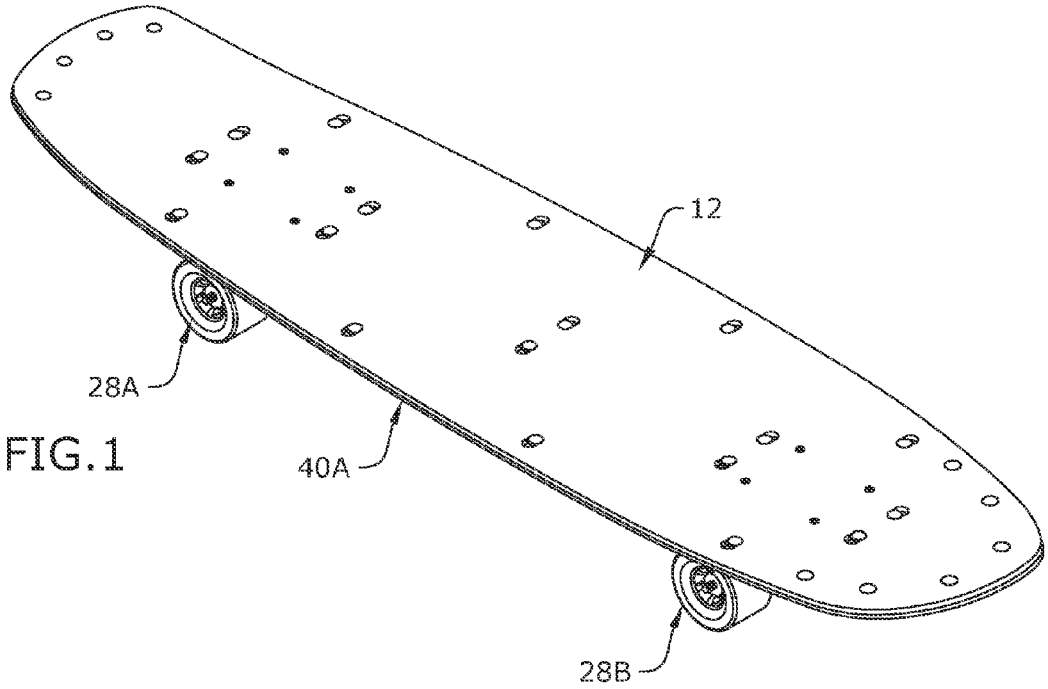
FIG. 1 is a top perspective view of an embodiment of the invention.
Figure 2:
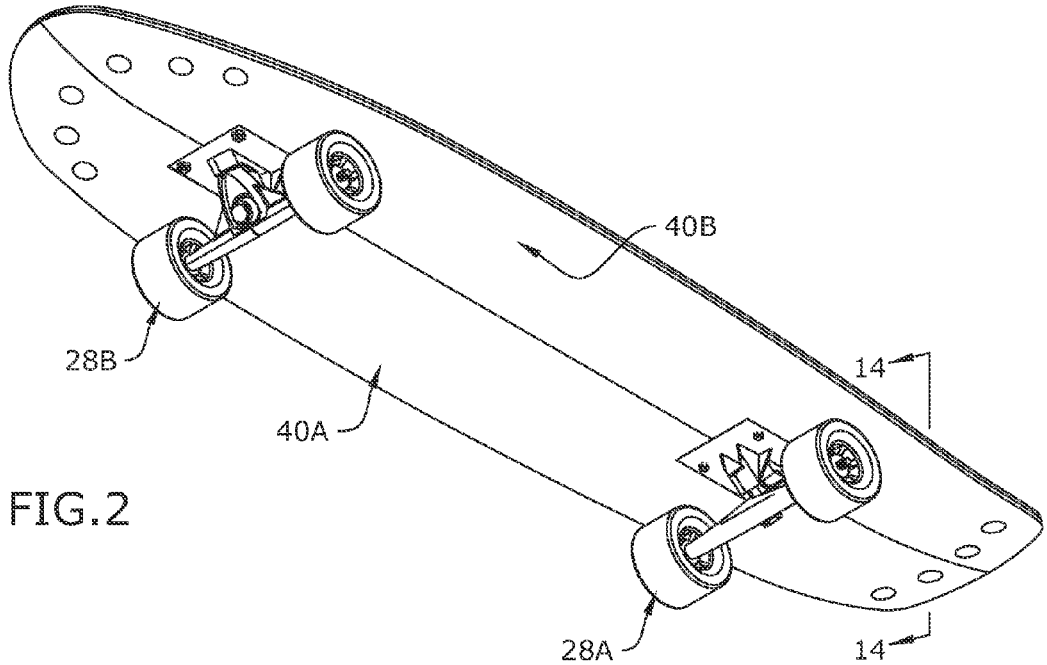
FIG. 2 is a bottom perspective view of an embodiment of the invention.
Figure 3:
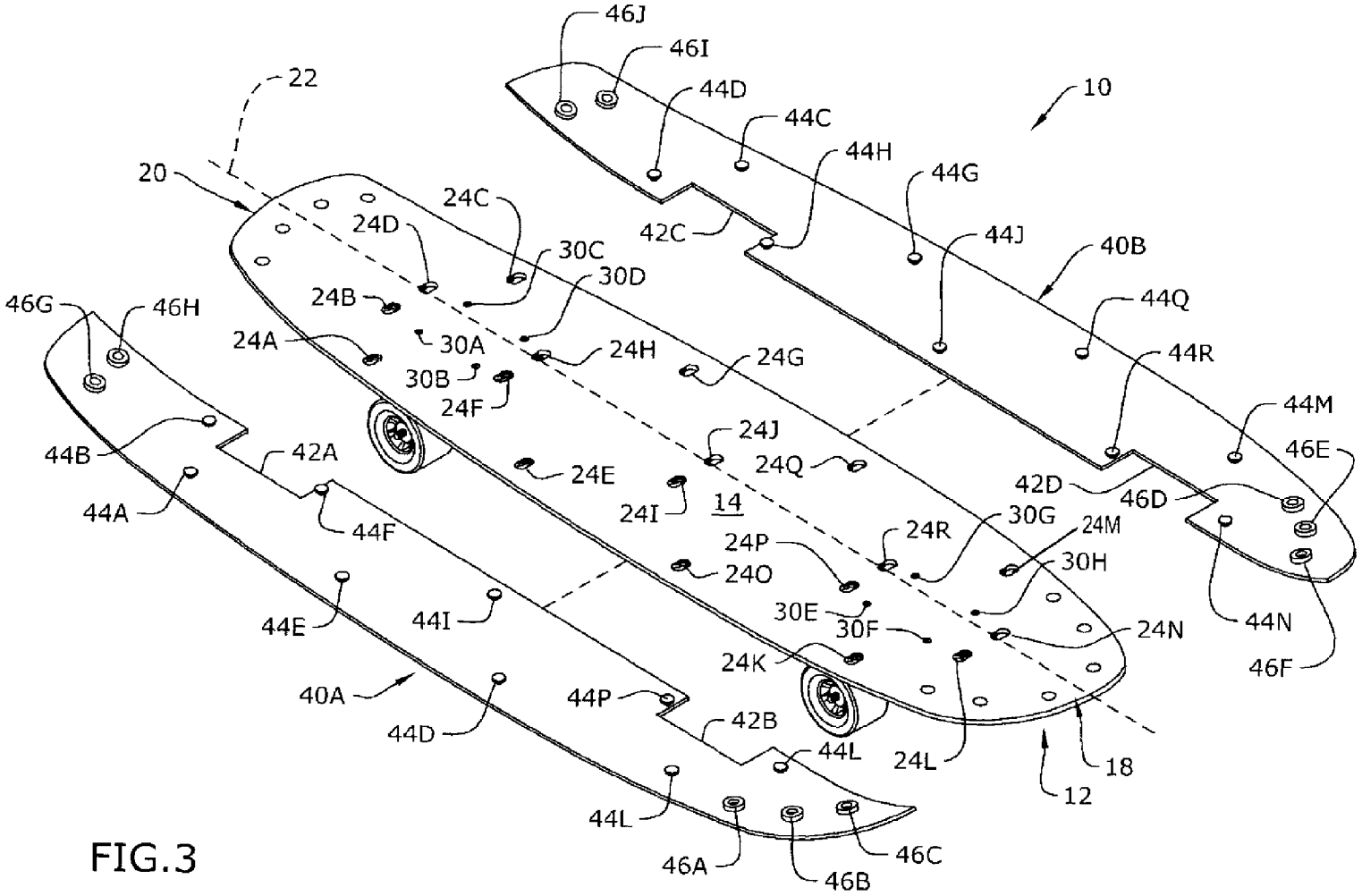
FIG. 3 is a top perspective exploded view of an embodiment of the invention.
Figure 4:
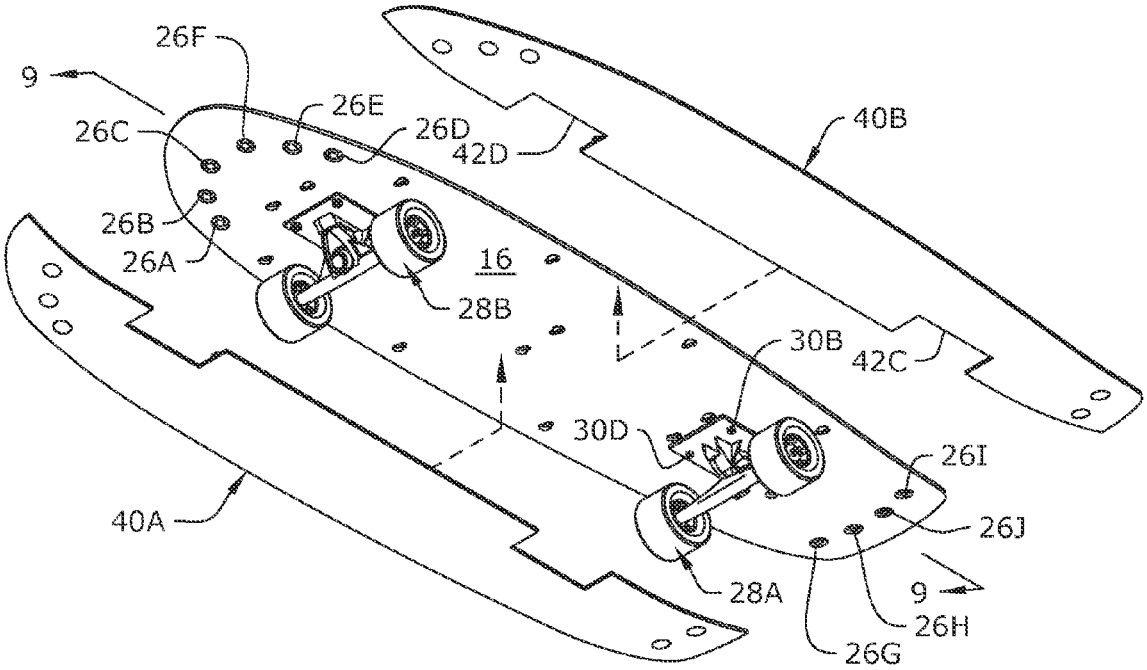
FIG. 4 is a bottom perspective exploded view of an embodiment of the invention.
Figure 5:
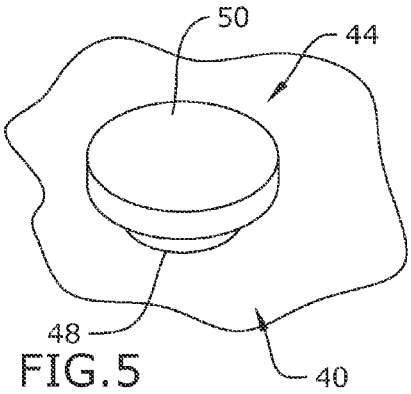
FIG. 5 is a top perspective view of the faceplate detailing the post component.
Figure 6:
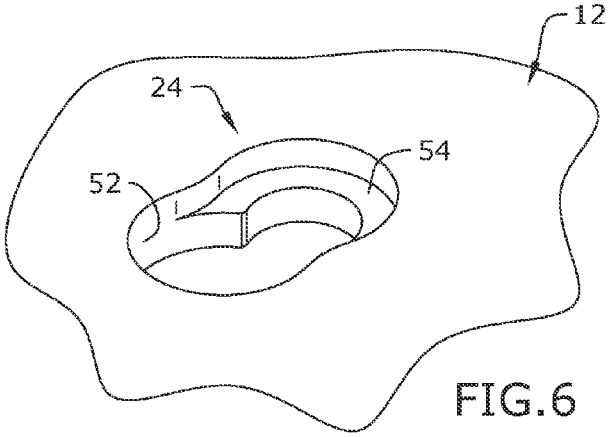
FIG. 6 is a top perspective view of the motherboard detailing slot component.
Figure 7:
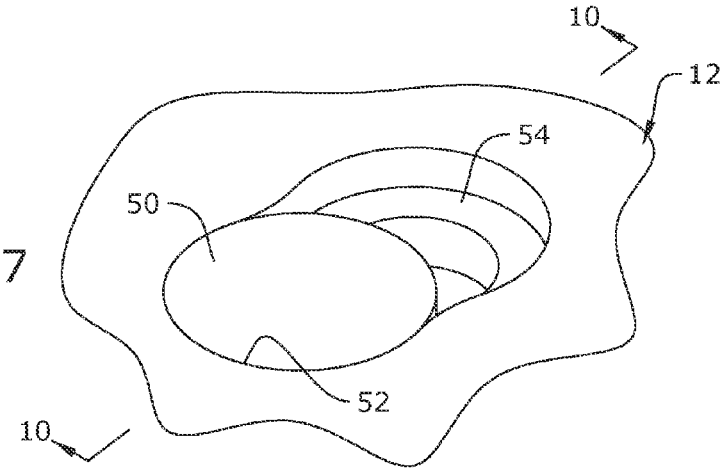
FIG. 7 is a perspective detail of the invention post component inserted into slot component but not in locked position.
Figure 8:
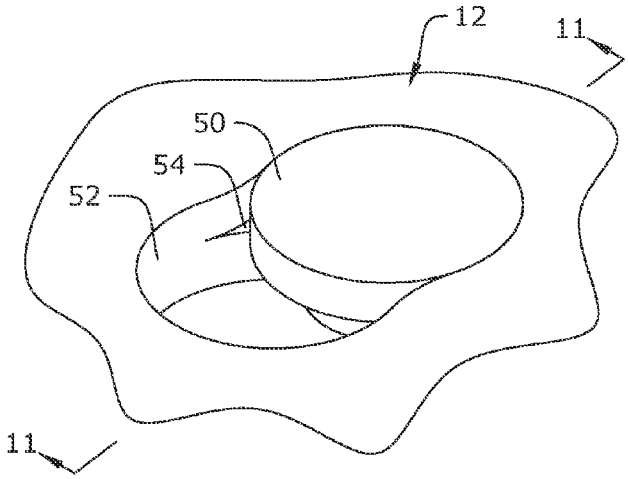
FIG. 8 is a perspective detail of the invention post component inserted into slot component and in locked position.
Figure 9:
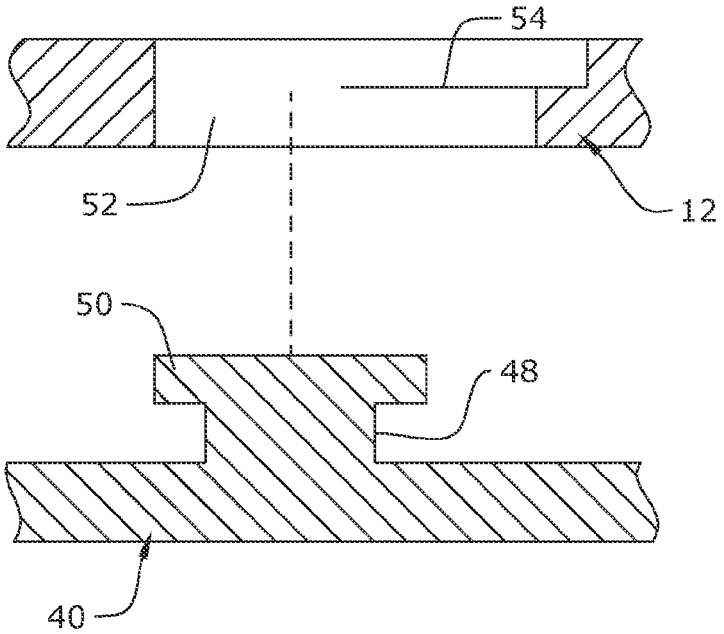
FIG. 9 is a section detail exploded view of an embodiment of the invention along line 9-9 in FIG. 4.
Figure 10:
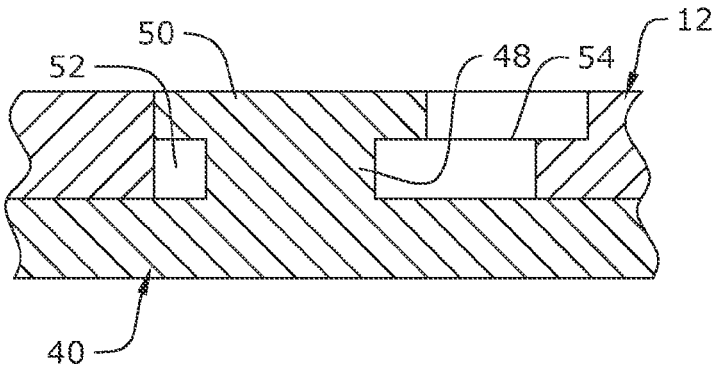
FIG. 10 is a section detail view of an embodiment of the invention along line 10-10 in FIG. 7.
Figure 11:
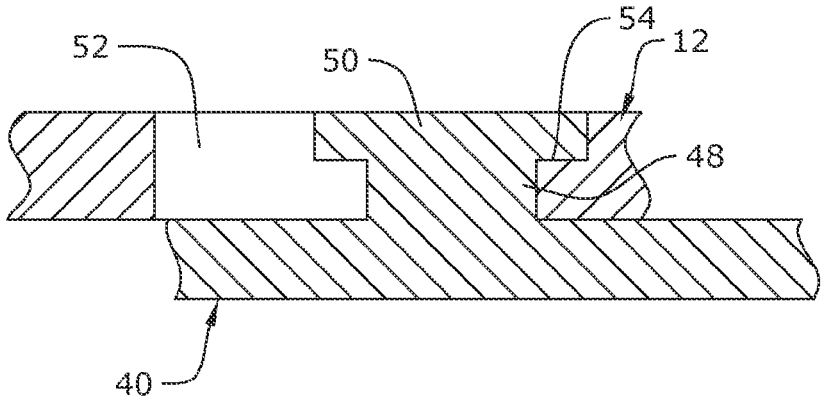
FIG. 11 is a section detail view of an embodiment of the invention along line 11-11 in FIG. 8.

By way of example, and referring to FIGS. 1 and 2, one embodiment of the skateboard accessory 10 comprises motherboard 12 attached to first faceplate 40A and second faceplate 40B.

Motherboard 12 further comprises top side 14, bottom side 16, front end 18 and rear end 20. Motherboard 12 is symmetrical about central axis 22 which runs from front end 18 to rear end 20.

Motherboard 12 further comprises a plurality of rearward slots 24. The plurality of rearward slots 24 further comprises outboard rearward first side slot 24A, inboard rearward first side slot 24B, outboard rearward second side slot 24C, and inboard rearward second side slot 24D. Outboard rearward first side slot 24A and outboard rearward second side slot 24C are symmetrically located on motherboard 12 about central axis 22. Inboard rearward first side slot 24B and inboard rearward second side slot 24D are symmetrically located on motherboard 12 about central axis 22.

Motherboard 12 further comprises a plurality of central rearward slots 24. The plurality of central rearward slots 24 further comprises outboard central rearward first side slot 24E, inboard central rearward first side slot 24F, outboard central rearward second side slot 24G, and inboard central rearward second side slot 24H. Outboard central rearward first side slot 24E and outboard central rearward second side slot 24G are symmetrically located on motherboard 12 about central axis 22. Inboard central rearward first side slot 24F and inboard central rearward second side slot 24H are symmetrically located on motherboard 12 about central axis 22.

Motherboard 12 further comprises a plurality of central slots 24. The plurality of central slots 24 further comprises inboard central first side slot 24I, and inboard central second side slot 24J. Inboard central first side slot 24I and inboard central second side slot 24J are symmetrically located on motherboard 12 about central axis 22.

Motherboard 12 further comprises a plurality of forward slots 24. The plurality of forward slots 24 further comprises outboard forward first side slot 24K, inboard forward first side slot 24L, outboard forward second side slot 24M, inboard forward second side slot 24N. Outboard forward first side slot 24K and outboard forward second side slot 24M are symmetrically located on motherboard 12 about central axis 22. Inboard forward first side slot 24L and inboard forward second side slot 24N are symmetrically located on motherboard 12 about central axis 22.

Motherboard 12 further comprises a plurality of central forward slots 24. The plurality of central forward slots 24 further comprises outboard central forward first side slot 24O, inboard central forward first side slot 24P, outboard central forward second side slot 24Q, and inboard central forward second side slot 24R. Outboard central forward first side slot 24O and outboard central forward second side slot 24P are symmetrically located on motherboard 12 about central axis 22. Inboard central forward first side slot 24Q and inboard central forward second side slot 24R are symmetrically located on motherboard 12 about central axis 22.

Motherboard 12 further comprises a plurality of forward male snap fasteners 26. The plurality of forward male snap fasteners 26 further comprises first side outboard forward male snap fastener 26A, first side central forward male snap fastener 26B, first side inboard forward male snap fastener 26C, second side outboard forward male snap fastener 26D, second side central forward male snap fastener 26E, and second side inboard forward male snap fastener 26F. First side outboard forward male snap fastener 26A and second side outboard forward male snap fastener 26D are symmetrically located on motherboard 12 about central axis 22. First side central forward male snap fastener 26B and second side central forward male snap fastener 26E are symmetrically located on motherboard 12 about central axis 22. First side inboard forward male snap fastener 26C and second side inboard forward male snap fastener 26F are symmetrically located on motherboard 12 about central axis 22.

The motherboard 12 further comprises a plurality of rearward male snap fasteners 26. The plurality of rearward male snap fasteners 26 further comprises first side outboard rearward male snap fastener 26G, first side inboard rearward male snap fastener 26H, second side outboard rearward male snap fastener 26I, and second side inboard rearward male snap fastener 26J. First side outboard rearward male snap fastener 26G and second side outboard rearward male snap fastener 26I are symmetrically located on motherboard 12 about central axis 22. First side inboard rearward male snap fastener 26H and second side inboard rearward male snap fastener 26J are symmetrically located on motherboard 12 about central axis 22.

Motherboard 12 is attached to rearward truck 28A with first side rearward truck bolts 30A, 30B and second side rearward truck bolts 30C, 30D. The first side rearward truck bolts 30A, 30B and the second side rearward truck bolts 30C, 30D are symmetrically located on motherboard 12 about central axis 22.

Motherboard 12 is attached to forward truck 28B with first side forward truck bolts 30E, 30F and second side forward truck bolts 30G, 30H. The first side forward truck bolts 30E, 30F and the second side forward truck bolts 30G, 30H are symmetrically located on motherboard 12 about central axis 22.

First faceplate 40A further comprises a first plurality of rearward track inserts 42. The first plurality of rearward track inserts 42 further comprises: first rearward track insert 42A and second rearward track insert 42B.

First faceplate 40A further comprises a plurality of rearward first side posts 44. The plurality of rearward first side posts 44 further comprises outboard rearward first side post 44A and inboard rearward first side post 44B.

First faceplate 40A further comprises a plurality of central rearward first side posts 44. The plurality of central rearward first side posts 44 further comprises outboard central rearward first side post 44E and inboard central rearward first side post 44F. First faceplate 40A further comprises an inboard central first side post 44I.

First faceplate 40A further comprises a plurality of forward first side posts 44. The plurality of forward first side posts 44 further comprises: outboard forward first side post 44K and inboard forward first side post 44L.

First faceplate 40A further comprises a plurality of central forward first side posts 44. The plurality of central forward first side posts 44 further comprises: outboard central forward first side post 44O, and inboard central forward first side post 44P.

First faceplate 40A further comprises a plurality of first side forward female snap fasteners 46. The plurality of first side forward female snap fasteners 46 further comprises: first side outboard forward female snap fastener 46A, first side central forward female snap fastener 46B, and first side inboard forward female snap fastener 46C.

First faceplate 40A further comprises a plurality of first side rearward female snap fasteners 46. The plurality of first side rearward female snap fasteners 46 further comprises: first side outboard rearward female snap fastener 46G and first side inboard rearward female snap fastener 46H.

Second faceplate 40B further comprises a second plurality of rearward track inserts 42. The second plurality of rearward track inserts 42 further comprises: second rearward track insert 42C and second rearward track insert 42D.

Second faceplate 40B further comprises a plurality of rearward second side posts 44. The plurality of rearward second side posts 44 further comprises outboard rearward second side post 44C and inboard rearward second side post 44D.

Second faceplate 40B further comprises a plurality of central rearward second side posts 44. The plurality of central rearward second side posts 44 further comprises outboard central rearward second side post 44G and inboard central rearward second side post 44H. Second faceplate 40B further comprises an inboard central second side post 44J.

Second faceplate 40B further comprises a plurality of forward second side posts 44. The plurality of forward second side posts 44 further comprises: outboard forward second side post 44M and inboard forward second side post 44N.

Second faceplate 40B further comprises a plurality of central forward second side posts 44. The plurality of central forward second side posts 44 further comprises: outboard central forward second side post 44Q, and inboard central forward second side post 44R.

Second faceplate 40B further comprises a plurality of second side forward female snap fasteners 46. The plurality of second side forward female snap fasteners 46 further comprises: second side outboard forward female snap fastener 46D, second side central forward female snap fastener 46E, and second side inboard forward female snap fastener 46F.

Second faceplate 40B further comprises a plurality of second side rearward female snap fasteners 46. The plurality of second side rearward female snap fasteners 46 further comprises: second side outboard rearward female snap fastener 46I and second side inboard rearward female snap fastener 46J.

FIGS. 5-11 show an example of a post 44, which could be any of the numerous posts described above. Each post 44 further comprises post body 48 attached to post head 50. The post body 48 is attached to a faceplate 40. Motherboard 12 has numerous slots 24. Each slot 24 further comprises slot opening 52 connected to slot ridge 54. To join faceplate 40 to motherboard 12 a user inserts each post head 50 into a slot opening 52 and then slides post head 50 onto slot ridge 54.

Figure 12:
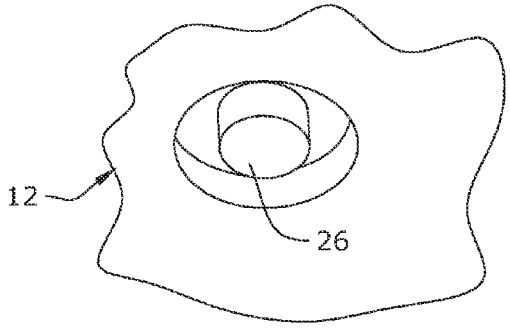
FIG. 12 is a detail perspective view of the male button.
Figure 13:
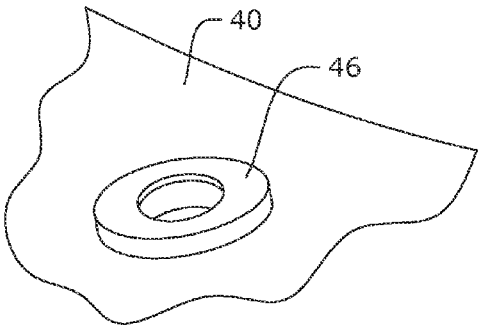
FIG. 13 is a detail perspective view of an embodiment of the female button.
Figure 14:
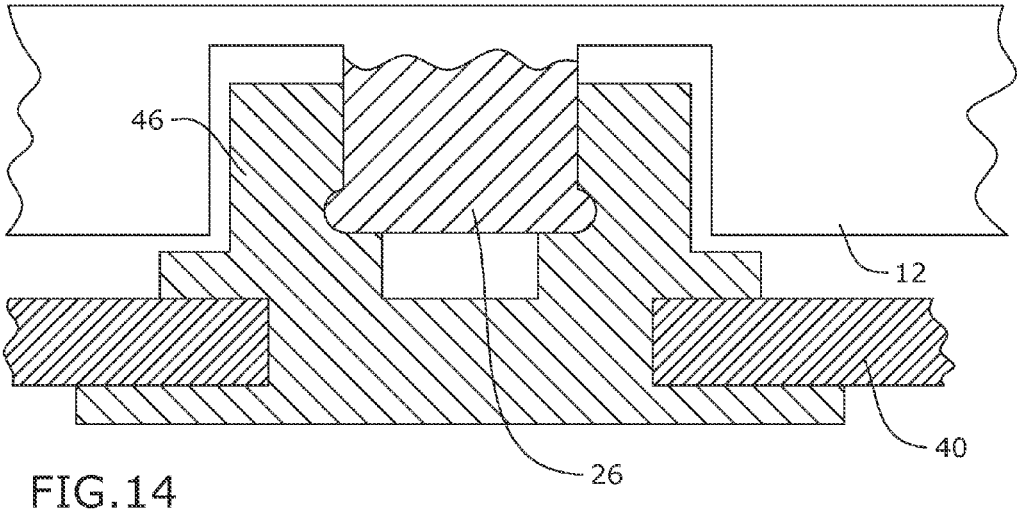
FIG. 14 is a section view of an embodiment of the invention along line 14-14 in FIG. 2.

FIGS. 12-14 show an example of a male snap 26, attached to motherboard 10 being joined in a female snap 46 attached to a faceplate 40. Note that the opening around male snap 26 is slightly larger than female snap 46 so that female snap 46 can deform outward into the opening around male snap 26. To join faceplate 40 to motherboard 12 a user inserts each male snap 26 into a female snap 46 and applies pressure until the connection is complete.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A skateboard configured to receive at least a first faceplate and a second faceplate, the skateboard comprising:

a motherboard further comprising a top side, a bottom side, a front end, and a rear end; wherein the motherboard is symmetrical about a central axis which runs from the front end to the rear end;

a forward truck and a rearward truck, attached to the motherboard;

a plurality of forward slots arranged symmetrically about the central axis on the motherboard;

a plurality of central forward slots arranged symmetrically about the central axis on the motherboard;

a plurality of central slots arranged symmetrically about the central axis on the motherboard;

a plurality of central rearward slots arranged symmetrically about the central axis on the motherboard; and a plurality of rearward slots arranged symmetrically about the central axis on the motherboard;

wherein the plurality of forward slots, the plurality of central forward slots, the plurality of central slots, the plurality of central rearward slots, and the plurality of rearward slots are adapted to receive the first and second faceplates;

a plurality of forward male snap fasteners, attached to the motherboard and configured to join the motherboard to the first and second faceplates; and a plurality of rearward male snap fasteners, attached to the motherboard and configured to join the motherboard to the first and second faceplates.

2. The skateboard of claim 1, wherein the first faceplate further comprises:

a plurality of forward first side posts configured to mate with the plurality of forward slots;

a plurality of central forward first side posts configured to mate with some of the plurality of central forward slots;

a central first side post configured to mate with one of the plurality of central slots;

a plurality of central rearward first side posts configured to mate with some of the plurality of central rearward slots; and a plurality of rearward first side posts configured to mate with some of the plurality of rearward slots.

3. The skateboard of claim 2, wherein the second faceplate further comprises:

a plurality of forward second side posts configured to mate with the plurality of forward slots;

a plurality of central forward second side posts configured to mate with some of the plurality of central forward slots;

a central second side post configured to mate with one of the plurality of central slots;

a plurality of central rearward second side posts configured to mate with some of the plurality of central rearward slots; and a plurality of rearward second side posts configured to mate with some of the plurality of rearward slots.

4. The skateboard of claim 1, wherein the first faceplate further comprises:

a plurality of first side forward female snap fasteners configured to mate with some of the plurality of forward male snap fasteners; and a plurality of first side rearward female snap fasteners configured to mate with some of the plurality of rearward male snap fasteners.

5. The skateboard of claim 4, wherein the second faceplate further comprises:

a plurality of second side forward female snap fasteners configured to mate with some of the plurality of forward male snap fasteners; and a plurality of second side rearward female snap fasteners configured to mate with some of the plurality of rearward male snap fasteners.

6. A skateboard configured to receive at least two faceplates, the skateboard comprising:

a motherboard further comprising a top side, a bottom side, a front end, and a rear end; wherein the motherboard is symmetrical about a central axis which runs from the front end to the rear end;

a forward truck and a rearward truck, attached to the motherboard;

a plurality of forward slots arranged symmetrically about the central axis on the motherboard;

a plurality of central forward slots arranged symmetrically about the central axis on the motherboard;

a plurality of central slots arranged symmetrically about the central axis on the motherboard;

a plurality of central rearward slots arranged symmetrically about the central axis on the motherboard; and a plurality of rearward slots arranged symmetrically about the central axis on the motherboard;

wherein the plurality of forward slots, the plurality of central forward slots, the plurality of central slots, the plurality of central rearward slots, and the plurality of rearward slots are adapted to receive the at least two faceplates;

a plurality of forward male snap fasteners, attached to the motherboard and configured to join the motherboard to the at least two faceplates; and a plurality of rearward male snap fasteners, attached to the motherboard and configured to join the motherboard to the at least two faceplates.

7. The skateboard of claim 6, wherein a first faceplate of the at least two faceplates further comprises:

a plurality of forward first side posts configured to mate with the plurality of forward slots;

a plurality of central forward first side posts configured to mate with some of the plurality of central forward slots;

a central first side post configured to mate with one of the plurality of central slots;

a plurality of central rearward first side posts configured to mate with some of the plurality of central rearward slots; and a plurality of rearward first side posts configured to mate with some of the plurality of rearward slots.

8. The skateboard of claim 7, wherein a second faceplate of the at least two faceplates further comprises:

a plurality of forward second side posts configured to mate with the plurality of forward slots;

a plurality of central forward second side posts configured to mate with some of the plurality of central forward slots;

a central second side post configured to mate with one of the plurality of central slots;

a plurality of central rearward second side posts configured to mate with some of the plurality of central rearward slots; and a plurality of rearward second side posts configured to mate with some of the plurality of rearward slots.

9. The skateboard of claim 6, wherein a first faceplate of the at least two faceplates further comprises:

a plurality of first side forward female snap fasteners configured to mate with some of the plurality of forward male snap fasteners; and a plurality of first side rearward female snap fasteners configured to mate with some of the plurality of rearward male snap fasteners.

10. The skateboard of claim 9, wherein a second faceplate of the at least two faceplates further comprises:

a plurality of second side forward female snap fasteners configured to mate with some of the plurality of forward male snap fasteners; and a plurality of second side rearward female snap fasteners configured to mate with some of the plurality of rearward male snap fasteners.

* * * * *